US005202650A

United States Patent [19]

Krill et al.

[11] Patent Number: 5,202,650

[45] Date of Patent: Apr. 13, 1993

[54] MATCHED SPURIOUS MODE ATTENUATOR AND TRANSITION FOR CIRCULAR OVERMODED WAVEGUIDE

[75] Inventors: Jerry A. Krill; William A. Huting, both of Ellicott City; Edward P. Irzinski, deceased, late of Gaithersburg, all of Md., by Diane M. Irzinski, personal representative

[73] Assignee: The Johns Hopkins University, Baltimore, Md.

[21] Appl. No.: 720,279

[22] Filed: Jun. 26, 1991

[51] Int. Cl.[5] ..... H01P 1/62

[52] U.S. Cl. ..... 333/034; 333/241; 333/242; 333/251

[58] Field of Search ..... 333/239, 241, 242, 251, 333/34

[56] References Cited

U.S. PATENT DOCUMENTS

| | | | |
|---|---|---|---|
| 2,915,715 | 12/1959 | Young, Jr. | 333/242 X |
| 3,110,001 | 11/1963 | Unger | 333/242 |
| 3,126,517 | 3/1964 | Miller | 333/34 |
| 3,835,423 | 9/1974 | Parisi | 333/251 |
| 4,553,112 | 11/1985 | Saad et al. | 333/34 X |

FOREIGN PATENT DOCUMENTS

| | | | |
|---|---|---|---|
| 453314 | 10/1970 | Japan | 333/34 |

OTHER PUBLICATIONS

Sugahara, H. et al.; "Echo Distortion due to Mode Conversion in Horn Reflector Antenna Feeding System"; *Electronics & Communications in Japan*; vol. 59-B; No. 6; Jun. 1976, pp. 77-85.

*Primary Examiner*—Robert J. Pascal
*Assistant Examiner*—Benny Lee
*Attorney, Agent, or Firm*—Robert E. Archibald; Francis A. Cooch

[57] ABSTRACT

A mode suppressor structure designed to maintain $TE_{01}$ mode matching in an overmoded waveguide, while at the same time allowing efficient coupling of unwanted modes for dissipation in the mode filtering structure of the overmoded waveguide, and in a manner which is non-intrusive on the $TE_{01}$ mode and thus promotes high power operation.

24 Claims, 3 Drawing Sheets

MATCHED SPURIOUS MODE ATTENUATOR AND TRANSITION FOR CIRCULAR OVERMODED WAVEGUIDE

STATEMENT OF GOVERNMENTAL INTEREST

This invention was made with Government support under Contract No. N00039-87-C-5301 awarded by the U.S. Navy Department. The Government has certain rights in this invention.

BACKGROUND OF THE INVENTION

The most common type of waveguide propagates signals in only one specific electromagnetic field pattern or mode, out of an infinite number of possible modes. Single-mode operation occurs because the waveguide is designed so that signals are in a frequency band which is sufficiently low that only the mode with the lowest "cutoff frequency" can exist and no other mode can propagate. If other modes were allowed to propagate, signal energy could couple into and out of various modes substantially distorting the signal. Such "conventional waveguide" is compact and easy to design, model and use. Unfortunately, maintaining only the lowest-cutoff mode in a given frequency band requires restriction of the waveguide cross section and this, in turn, restricts power carrying capacity and limits the lowest achievable signal attenuation. As a result, design of some systems requiring microwave or millimeter wave signal transmission with high power or very low loss may be difficult or impractical.

An alternative type of waveguide is generally called "overmoded" in which a higher order mode is used, i.e. a mode which does not have the lowest cutoff frequency. Because other (unwanted) modes are also capable of existing as well as the desired transmission mode, this type of waveguide must feature internal structures which suppress the unwanted modes. Because internal structure, rather than restriction of cross section dimensions, is the basis for suppressing all but the desired mode, overmoded waveguide cross section can, in principle, be made arbitrarily large for a corresponding increase in power capacity and decrease in signal attenuation. Unfortunately, this type of waveguide, with unwanted mode suppression, is difficult to model and design, and its cross-sectional dimensions may not be amenable to compactness without significant design optimization. A computer-aided method for designing such optimized overmoded waveguide is described in copending and commonly assigned application, Ser. No. 310,193 filed Feb. 13, 1989 which issued as U.S. Pat. No. 5,046,016 on Sep. 3, 1991.

Historically, the more successful type of overmoded waveguide supports the circular $TE_{01}$ mode, e.g. see H. E. Rowe and W. D. Warters, "Transmission in Multimode Waveguide with Random Imperfections", Bell System Technical Journal, Vol. 41, No. 3, pp. 1031–1070, May 1962. Such waveguide uses either a dielectric lining or dielectric sheathed helix of insulated wire inside the circular cross section waveguide for suppression and decoupling of unwanted modes, e.g. see A. E. Karbowiak "Trunk Waveguide Communication", Chapmen and Hall Ltd. 1965. Both versions of overmoded $TE_{01}$ waveguide were originally developed and tested for millimeter band (60–100 GHz) trunk line telecommunications between cities. Application of overmoded waveguide technology for high power and/or low loss transmission in microwave or millimeter wave radio communications and radar has also been suggested and developed to a limited degree, e.g. see R. M. Collins "Practical Aspects of High Power Circular Waveguide Systems" NEREM Record, Session 24, pp 182–183,(1962).

Circular $TE_{01}$ mode waveguide systems generally feature mode suppression, either distributed filtering along the transmission length or at discrete intervals. As a result, the relatively low power is coupled into unwanted modes by waveguide imperfections, bends, and transitions, and unwanted mode energy that does arise is converted to heat. One apparent feature of mode suppression filtering is that components in overmoded waveguide may be matched to the desired $TE_{01}$ mode at terminations and transitions; however, the undesired modes are generally not. See for example, A. P. King and E. A. Marcatili, "Transmission Loss due to Resonances of Loosely Coupled Modes in a Multimode System", Bell System Technical Journal, Vol. 35, pp. 899–906 (1956). The resulting reflections due to high VSWR for these unwanted modes can lead to trapped resonances and inefficient mode suppression. This can be especially of concern for high power capacity systems in which although only a small percentage of energy is coupled into unwanted modes, appreciable RF energy is built up without proper purging from the system.

The prior art includes various structure for filtering or suppressing unwanted modes. For example, U.S. Pat. No. 2,760,171 to King discloses a mode filter consisting of a circular metallic waveguide filled with several pieces of dielectric material, each with a pie-shaped cross-section. Between each pair of these pie-shaped spacers is placed a resistive card. These cards must be tapered to minimize spurious mode reflectivity. This prior art device does not provide for an impedance match for the $TE_{01}$ mode and there is some residual $TE_{01}$ mode reflectivity because of the interface between the dielectric spacers and the rest of the waveguide which is air-filled. Further, the filled cross-section of this patented structure is not compatible with very low loss and high power operation contemplated by the present invention, due to the edges of the resistive cards, potential dielectric strength problems, and dielectric losses introduced thereby. Moreover, as will be explained, the present invention has the distinct advantage of locating the structural variations outside the region of the $TE_{01}$ mode propagation.

The Albersheim U.S. Pat. No. 2,779,006 relates to $TE_{01}$ mode transmission through curved waveguide and it utilizes transverse slots in the waveguide bend to minimize generation of the spurious modes. Although this patent mentions the problem of providing an impedance match between the slotted and unslotted sections of waveguide, it does not describe how one might accomplish this.

The Clogston U.S. Pat. No. 2,948,870 teaches the placement of small ferromagnetic discs at the axis of a circular waveguide for mode suppression. The electromagnetic properties of these discs are controlled by an externally generated D.C. field. This device does include lossy dielectric tapers for the purpose of an impedance match, apparently for both the $TE_{01}$ and the undesired modes. Since these tapers do have lossy components, they do not maximize $TE_{01}$ transmission. Furthermore, as noted, the transitions and the mode-suppressing discs are located in the center of the waveguide and are supported by polystyrene spiders. Each spider consists of a hub through which runs a cylindrical member of dielectric material containing the discs, the hub being supported in the center of the waveguide by spokes or arms radiating from the hub to the waveguide's interior wall. These spiders cause additional $TE_{01}$ reflectivity and there are no tapered structures located in this device to minimize this additional reflectivity. In contrast, in accordance with the present invention, all of the mode suppressions in the proposed structure are located on the periphery of the waveguide (e.g. outside the helix wall supporting the $TE_{01}$ mode), no spiders are needed, and all of the varying physical and electrical characteristics are introduced in a gradual manner along the length of the waveguide.

In the device taught in the Nakahara et al U.S. Pat. No. 3,601,720, the waveguide lining has a varying dielectric constant so that in some parts of the waveguide the $TE_{01}$ mode is damped while in other parts the $TE_{12}$ mode is damped. In contrast to the present invention, there is no provision in this prior art reference for a varying thickness other than as a taper in one configuration. However, this patent does not address the problem of purging all residual unwanted mode loss and matching to an end transition, as accomplished by the present invention.

SUMMARY OF THE INVENTION

In light of the foregoing discussion, the novel mode suppressor structure proposed in accordance with the present invention is designed to maintain $TE_{01}$ mode matching, while at the same time allowing efficient coupling of unwanted modes for dissipation in the mode filtering structure of the overmoded waveguide, and in a manner which is non-intrusive on the $TE_{01}$ mode and thus promotes high power operation.

The main object of the present invention is thus to provide an improved mode suppressor structure for overmoded waveguide applications.

Other objects, purposes and characteristics of the present invention will be pointed out or be obvious as the description of the invention progresses, with reference to the accompanying drawings wherein.

DESCRIPTION OF THE PREFERRED EMBODIMENT

Figure 1:
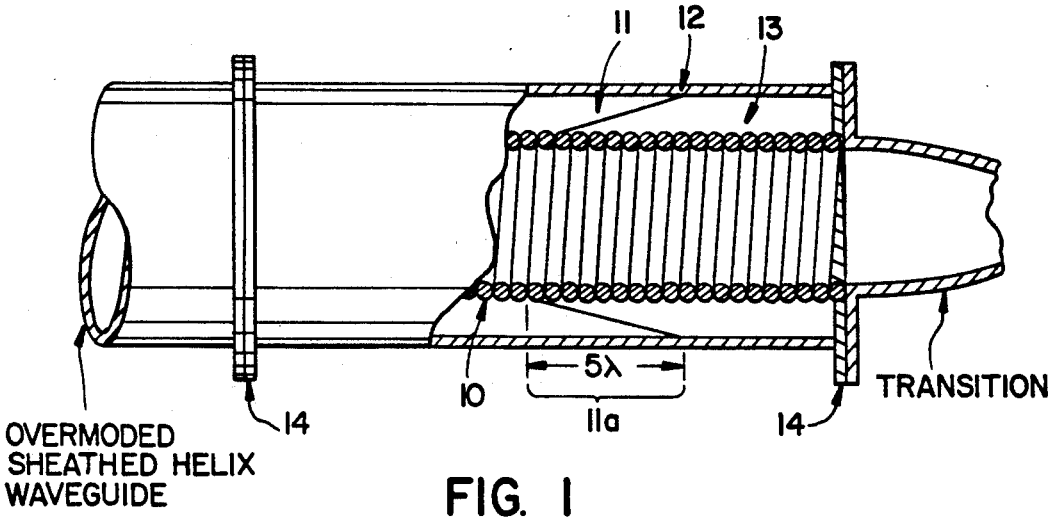
FIG. 1 is a side plan view of the presently preferred embodiment of the proposed mode suppressor structure.

Referring first to FIG. 1, the presently preferred embodiment of the proposed mode suppressor structure is illustrated in a circular overmoded waveguide configuration of the sheathed helix type, comprising wire helix 10 covered by dielectric sheath 11 and outer aluminum wall 12. One end of the sheath 11 is formed with a female conical tapered section 11*a* which mates with a corresponding male conical tapered section of a lossy dielectric sheath member 13 that surrounds the helix 10 within the aluminum wall 12 adjacent its right-hand end in FIG. 1. The length of the tapered transition section 11*a* is approximately five (5) freespace wavelengths λ at the operating frequency. End flanges 14 connect the illustrated mode suppressor, at the left-hand end in FIG. 1, to other sheathed helix circular overmoded waveguide (not shown) and, at the opposite end, to some other waveguide structure within the over-all waveguide system, e.g. a transition from a circular waveguide to rectangular waveguide.

Figure 2:
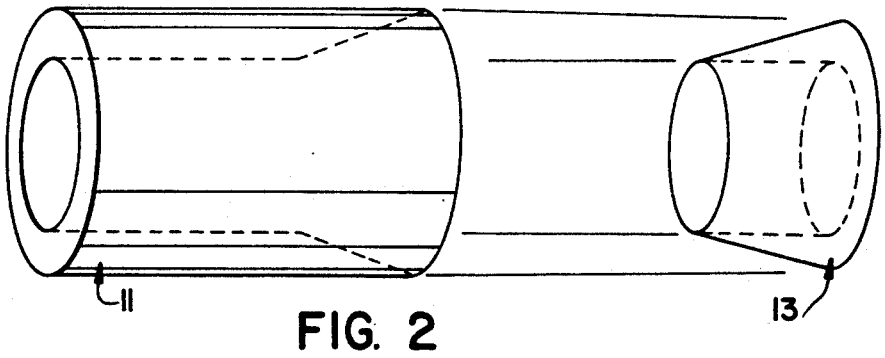
FIG. 2 is a simplified isometric view of the dielectric components of the proposed mode suppressor structure of FIG. 1.
Figure 3A:
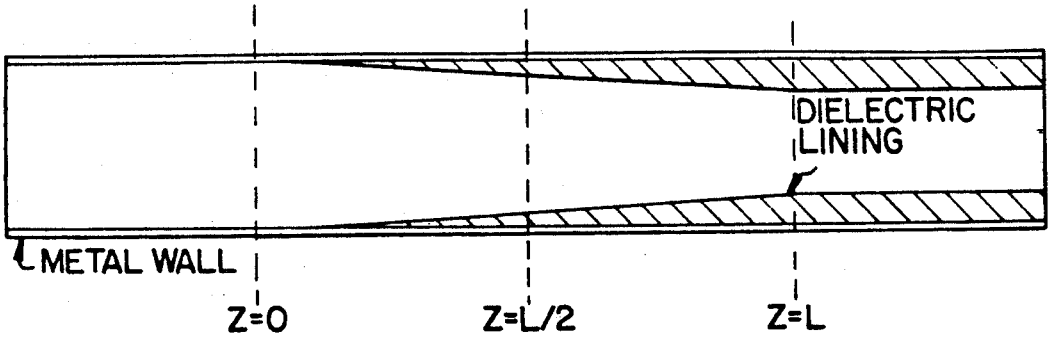
FIGS. 3*a* through 3*e* diagrammatically illustrates several other embodiments of structure proposed in accordance with the present invention for gradually transitioning between mode-suppressing sections and other overmoded waveguide.
Figure 3B:
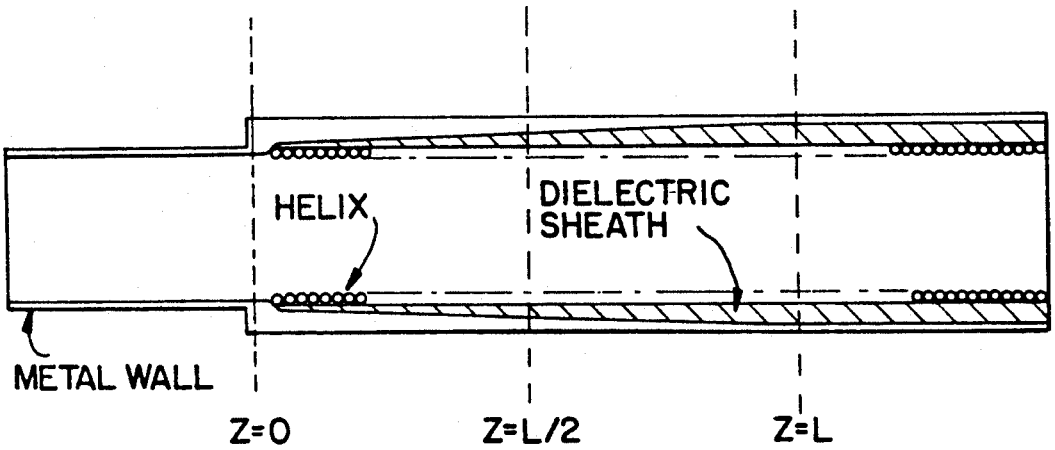
Figure 3C:
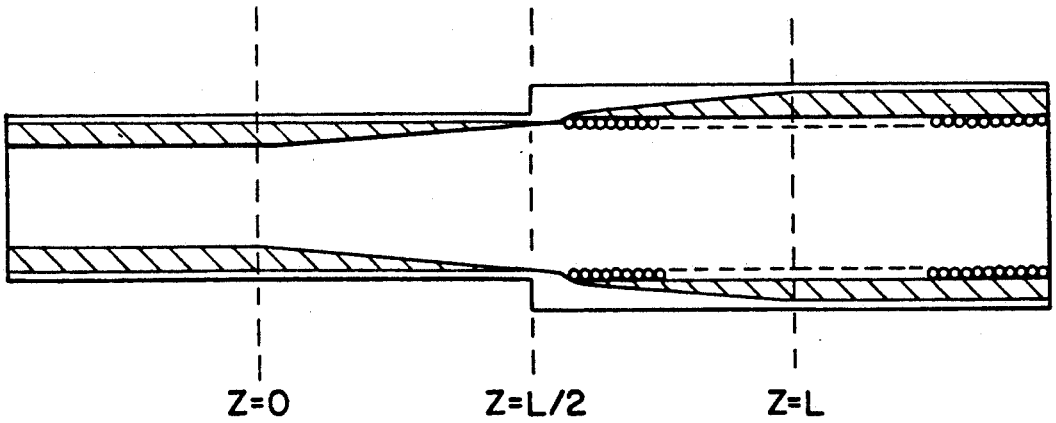
Figure 3D:
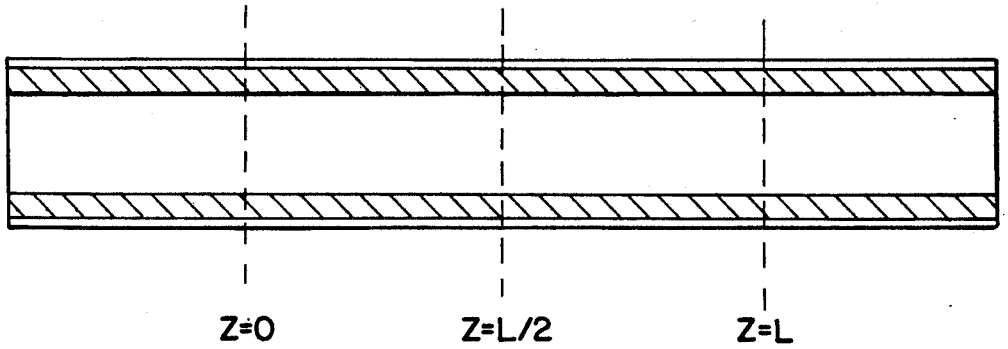
Figure 3E:
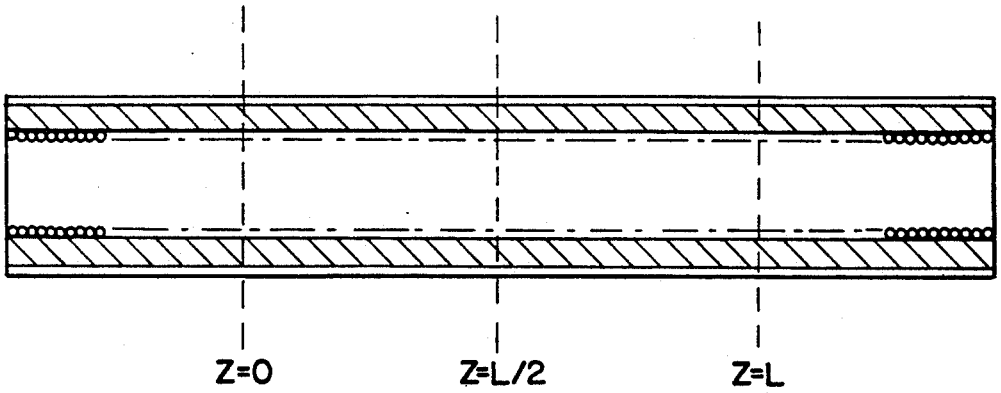

FIG. 2 of the drawings shows the two dielectric sheath components 11 and 13 separated from one another, to illustrate their respective configurations. The sheath 11 might be fabricated by injecting suitable RTV dielectric material into the space between the waveguide wall (designated at 12 in FIG. 1) and a centrally aligned mandrel upon which has been wound the helix wire 10. The tapered end on the sheath 11 could be formed by properly positioning a conical sleeve between the wall 12 and the helix 10, and formed with suitable holes to vent air as the RTV material is being injected. After the sheath 12 has cured, the mandrel and conical sleeve would be removed and the lossy dielectric then injected and cured to complete the fabrication. To facilitate an understanding of such a fabrication process, reference is made to copending and commonly assigned patent application, Ser. No. 194 364 which was filed May 16, 1988 which issued as U.S. Pat. No. 5,003,687 on Apr. 2, 1991.

FIG. 3 illustrates several alternative configurations for gradual transitioning between mode-suppressing sections and other overmoded waveguide, in accordance with the present invention. Specifically, in each of the diagrams 3*a* through 3*e*, the transition occurs between the planes $z=0$ and $z=L$ in FIG. 3, where L is approximately equal to 5λ. As can be seen, the proposed transition may take the form of (a) a gradual dielectric taper (in thickness and/or varying dielectric constant) between the illustrated metal pipe waveguide and lined dielectric waveguide; (b) a gradual change in the conducting wall diameter, together with a dielectric sheath taper (in thickness and/or varying dielectric constant) between a sheathed-helix waveguide and a metal pipe waveguide; (c) a gradual dielectric lining taper coupled with a combined wall diameter change and sheath taper for connecting lined dielectric and sheathed-helix waveguide; (d) a dielectric lining with gradual change in complex dielectric constant (ε) or in thickness for connection between two different lined dielectric waveguides; or, (e) a dielectric sheath with gradual change in complex dielectric constant (ε) or in thickness for connecting two different sheathed-helix waveguides. It is contemplated that a gradual change in dielectric constant can be accomplished in various ways. For example, it might be done by using a plurality (approximately twenty) segments of dielectric material, each with a slightly different dielectric constant, one after another to form the dielectric lining/sheath taper or by suitable processing a dielectric lining/sheath material to exhibit a gradual change in dielectric constant along its length.

Various other modifications, adaptations and alterations to the illustrated embodiment will of course be obvious to one of ordinary skill in the art in light of the foregoing description and accompanying drawings. It should thus be understood that within the scope of the appended claims, the present invention may practiced otherwise than as specifically set forth hereinabove.

What we claim is:

1. In a waveguide system having a circular overmoded waveguide for propagating electromagnetic signals at an operating frequency in the circular $TE_{01}$ mode, the improvement comprising, at least one mode suppressing waveguide section for suppressing unwanted modes of said electromagnetic signals, and a transition section for connecting said circular overmoded waveguide to said at least one mode suppressing waveguide section, said transition section having impedances respectively matched to impedances associated with the $TE_{01}$ mode and the unwanted modes, whereby said unwanted modes are efficiently coupled to said at least one mode suppressing waveguide section to minimize spurious resonances within said waveguide system, wherein said transition section comprises a sheathed helix waveguide section including an inner helix wire, a dielectric sheath surrounding said helix wire, and an outer conducting wall surrounding the dielectric sheath, said dielectric sheath having a transition region wherein the sheath has a dielectric constant which varies gradually between preselected values, and wherein the transition region has a length which is approximately 5λ, where λ=freespace wavelength of said electromagnetic signals at the operating frequency of the waveguide system.

2. In a waveguide system having a circular overmoded waveguide for propagating electromagnetic signals in the circular $TE_{01}$ mode, the improvement comprising, at least one mode suppressing waveguide section for suppressing unwanted modes of said electromagnetic signals, and a transition section for connecting said circular overmoded waveguide to said at least one mode suppressing waveguide section, said transition section having impedances respectively matched to impedances associated with the $TE_{01}$ mode and the unwanted modes, whereby said unwanted modes are efficiently coupled to said at least one mode suppressing waveguide section to minimize spurious resonances within said waveguide system, wherein said transition section comprises a sheathed helix waveguide section including an inner helix wire, a dielectric sheath surrounding said helix wire, and an outer conducting wall surrounding the dielectric sheath, said dielectric sheath having a transition region wherein the sheath has a dielectric constant which varies gradually between preselected values, and wherein the transition region has mated, conical tapers of two dielectric materials having different dielectric constants.

3. In a waveguide system having a circular overmoded waveguide for propagating electromagnetic signals at an operating frequency in the circular $TE_{01}$ mode, the improvement comprising, at least one mode suppressing waveguide section for suppressing unwanted modes of said electromagnetic signals, and a transition section for connecting said circular overmoded waveguide to said at least one mode suppressing waveguide section, said transition section having a length and also impedances respectively matched to impedances associated with the $TE_{01}$ mode and the unwanted modes, whereby said unwanted modes are efficiently coupled to said at least one mode suppressing waveguide section to minimize spurious resonances within said waveguide system, and wherein said transition section has a length of approximately 5λ, where λ=freespace wavelength of said electromagnetic signals at the operating frequency of the waveguide system.

4. The improved waveguide system specified in claim 3 wherein said circular overmoded waveguide and said at least one mode suppressing waveguide section each comprise a sheathed-helix waveguide and said transition section comprises a graduated dielectric sheath matched in dielectric constant at respective ends of said transition section to said sheathed-helix waveguides.

5. The improved waveguide system specified in claim 4 wherein said graduated dielectric sheath has a gradual change in dielectric constant.

6. The improved waveguide system specified in claim 3 wherein said circular overmoded waveguide comprises a metal wall circular waveguide and said at least one mode suppressing waveguide section comprises a dielectric lined circular waveguide and said transition section comprises a circular waveguide having an inner dielectric taper for gradually transitioning between said metal wall circular waveguide and said dielectric lined waveguide.

7. The improved waveguide system specified in claim 6 wherein said dielectric taper comprises a cylindrical dielectric lining which tapers beginning adjacent the metal wall waveguide and extends over the length of said transition section to match in thickness the dielectric lining within said dielectric lined circular waveguide.

8. The improved waveguide system specified in claim 6 wherein said inner dielectric taper comprises a dielectric liner with varying dielectric constant.

9. The improved waveguide system specified in claim 6 wherein said dielectric taper comprises a cylindrical dielectric lining which tapers beginning adjacent the metal wall waveguide and extends over the length of said transition section to match in dielectric constant the dielectric lining with said dielectric lined circular waveguide.

10. The improved waveguide system specified in claim 6 wherein said inner dielectric taper comprises a dielectric liner with varying thickness.

11. The improved waveguide system specified in claim 3 wherein said circular overmoded waveguide and said at least one mode suppressing waveguide section each comprise a sheathed-helix waveguide and said transition section comprises a graduated dielectric sheath matched in thickness at respective ends of said transition section to said sheathed-helix waveguides.

12. The improved waveguide system specified in claim 11 wherein said graduated dielectric sheath has a gradual change in thickness.

13. The improved waveguide system specified in claim 3 wherein said circular overmoded waveguide comprises a circular metal wall waveguide and said at least one mode suppressing waveguide section comprises a circular waveguide having a helix wire and a dielectric sheath and said transition section comprises a circular waveguide having (a) a helix wire connected to the helix wire of said sheath helix circular waveguide, (b) a dielectric sheath surrounding the helix wire of said transition section and gradually tapered, over the length of said transition section, beginning adjacent said metal wall waveguide to match in thickness the dielectric sheath of said sheathed helix circular waveguide, and (c) an outer conductor wall with a thickness which gradually decreases, over the length of said transition section, beginning adjacent said metal wall waveguide.

14. The improved waveguide system specified in claim 13 wherein said dielectric sheath within said transition section has a varying thickness.

15. The improved waveguide system specified in claim 3 wherein said circular overmoded waveguide comprises a waveguide having a dielectric liner and said at least one mode suppressing waveguide section comprises a sheathed waveguide having a helix wire and said transition section comprises (a) a first half-section including a dielectric liner having one end which matches in thickness the dielectric liner of said waveguide and tapered to zero thickness at an opposite end and (b) a second half-section including (i) a helix wire connected to the helix wire of said sheathed waveguide, (ii) a dielectric sheath surrounding the helix wire of said transition section and gradually tapered, over the length of said second half-section, beginning at said opposite end of said first half-section to match in thickness the dielectric sheath of said sheathed waveguide, and (iii) an outer conductor wall whose thickness gradually decreases, over the length of said second half-section, beginning at said opposite end of said first half-section.

16. The improved waveguide system specified in claim 15 wherein said dielectric sheath within said transition section has a varying thickness.

17. The improved waveguide system specified in claim 3 wherein said circular overmoded waveguide and said at lest one mode suppressing waveguide section each comprise a dielectric lined waveguide and said transition section comprises a graduated dielectric lining matched in dielectric constant at respective ends of said transition section to said dielectric lined waveguides.

18. The improved waveguide system specified in claim 17 wherein said graduated dielectric lining has a gradual change in dielectric constant.

19. The improved waveguide system specified in claim 3 wherein said circular overmoded waveguide comprises a waveguide having a dielectric liner and said at least one mode suppressing waveguide section comprises a sheathed waveguide having a helix wire and said transition section comprises (a) a first half-section including a dielectric liner having one end which matches in thickness the dielectric liner of said waveguide and tapered to zero thickness at an opposite end and (b) a second half-section including (i) a helix wire connected to the helix wire of said sheathed waveguide, (ii) a dielectric sheath surrounding the helix wire of said transition section and gradually tapered, over the length of said second half-section, beginning at said opposite end of said first half-section to match in dielectric constant the dielectric sheath of said sheathed waveguide, and (iii) an outer conductor wall whose thickness gradually decreases, over the length of said second half-section, beginning at said opposite end of said first half-section.

20. The improved waveguide system specified in claim 19 wherein said dielectric sheath within said transition section has a varying dielectric constant.

21. The improved waveguide system specified in claim 3 wherein said circular overmoded waveguide and said at least one mode suppressing waveguide section each comprise a dielectric lined waveguide and said transition section comprises a graduated dielectric lining matched in thickness at respective ends of said transition section to said dielectric lined waveguides.

22. The improved waveguide system specified in claim 21 wherein said graduated dielectric lining has a gradual change in thickness.

23. The improved waveguide system specified in claim 3 wherein said circular overmoded waveguide comprises a circular metal wall waveguide and said at least one mode suppressing waveguide section comprises a circular waveguide having a helix wire and a dielectric sheath and said transition section comprises a circular waveguide having (a) a helix wire connected to the helix wire of said sheath helix circular waveguide, (b) a dielectric sheath surrounding the helix wire of said transition section and gradually tapered, over the length of said transition section, beginning adjacent said metal wall waveguide to match in dielectric constant the dielectric sheath of said sheathed helix circular waveguide, and (c) an outer conductor wall with a thickness which gradually decreases, over the length of said transition section, beginning adjacent said metal wall waveguide.

24. The improved waveguide system specified in claim 23 wherein said dielectric sheath within said transition section has a varying dielectric constant.

* * * * *

UNITED STATES PATENT AND TRADEMARK OFFICE

CERTIFICATE OF CORRECTION

PATENT NO. : 5,202,650

DATED : April 13, 1993

INVENTOR(S) : Jerry A. Krill, William A. Huting, and Edward P. Irzinski

It is certified that error appears in the above—identified patent and that said Letters Patent is hereby corrected as shown below:

Column 6, line 41, delete "with" and substitute therefor -- within --.

Column 6, line 63, delete "sheath" and substitute therefor -- sheathed --.

Column 8, line 33, delete "sheath" and substitute therefor -- sheathed --.

Signed and Sealed this

Thirtieth Day of November, 1993

Bruce Lehman

*Attest:*

BRUCE LEHMAN

*Attesting Officer*

*Commissioner of Patents and Trademarks*